US005281130A

United States Patent [19]

LeBaigue

[11] Patent Number: 5,281,130

[45] Date of Patent: Jan. 25, 1994

[54] DOMESTIC GAS FIRES

[75] Inventor: Stanley J. LeBaigue, Broadstairs, United Kingdom

[73] Assignee: LeBaigue Research Limited, Kent, United Kingdom

[21] Appl. No.: 560,277

[22] Filed: Jul. 30, 1990

Related U.S. Application Data

[63] Continuation of Ser. No. 299,502, Jan. 23, 1989, abandoned.

[51] Int. Cl.[5] ..... F24C 3/00

[52] U.S. Cl. ..... 431/125; 126/512; 126/92 AC; 431/328

[58] Field of Search ..... 431/326, 328, 329, 7, 431/170, 51, 125; 126/92 R, 92 AC, 512

[56] References Cited

U.S. PATENT DOCUMENTS

| | | | |
|---|---|---|---|
| 1,978,518 | 10/1934 | Wetherbee | 431/328 X |
| 3,073,379 | 1/1963 | Martin | 431/258 |
| 3,362,395 | 1/1968 | Peterson | 126/92 |
| 3,385,651 | 5/1968 | Rasmussen et al. | 126/512 X |
| 3,583,845 | 6/1971 | Pulone | 126/512 X |
| 3,671,175 | 6/1972 | Campbell | 126/512 X |
| 3,762,639 | 10/1973 | Katchka et al. | 431/51 X |
| 3,857,669 | 12/1974 | Smith et al. | 431/328 |
| 4,110,063 | 8/1978 | Mitchell | 431/328 X |
| 4,220,132 | 9/1980 | Streisel | 431/328 X |
| 4,224,018 | 9/1980 | Smith | 431/328 |
| 4,547,148 | 10/1985 | Holmer | 431/328 |
| 4,597,734 | 7/1986 | McCausland et al. | 431/326 X |
| 4,604,054 | 8/1986 | Smith | 431/328 |
| 4,718,846 | 1/1988 | Oguri et al. | 126/92 AC |

FOREIGN PATENT DOCUMENTS

| | | |
|---|---|---|
| 1561099 | 2/1980 | United Kingdom . |
| 2193802 | 2/1988 | United Kingdom . |

*Primary Examiner*—Carl D. Price

*Attorney, Agent, or Firm*—Pollock, Vande Sande & Priddy

[57] ABSTRACT

A burner tray (10) for a domestic gas fire has a gas inlet (12), and a ceramic fibre blanket (18) lining its bottom surface (11), the blanket distributing gas over substantially the whole area of the tray while reducing heat loss to the tray and increasing the heat output of the fire.

9 Claims, 1 Drawing Sheet

FIG.1
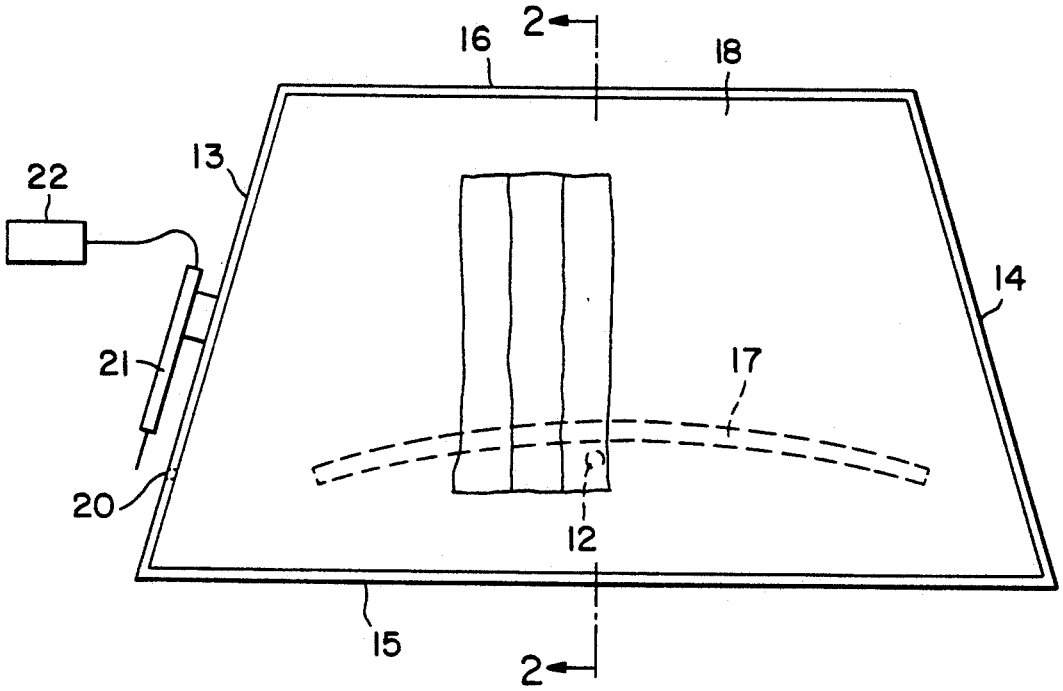
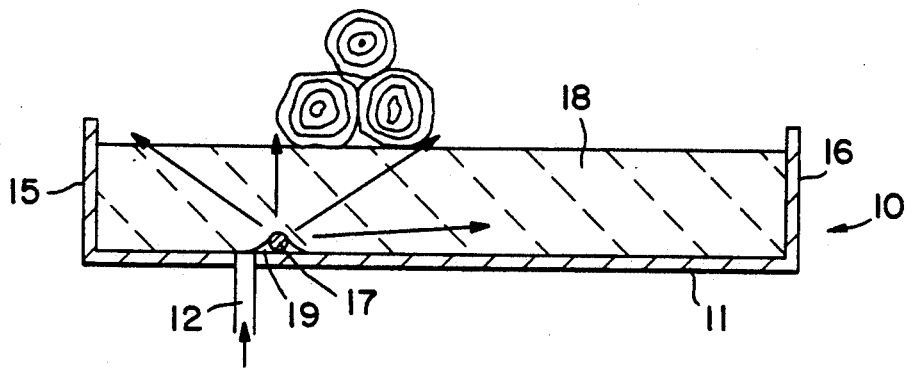
FIG.2

DOMESTIC GAS FIRES

This application is a continuation of application Ser. No. 07/299,502 filed Jan. 23, 1989 now abandoned.

BACKGROUND OF INVENTION

This invention relates to a domestic gas fire, particularly a decorative coal or log effect gas fire.

To provide a coal or log effect gas fire, the gas from a domestic supply is first distributed over the area of a fire burner tray which is fitted in the fire grate. The most common method at present used for distributing the gas is to fill the tray with silica sand which covers a gas inlet in the bottom of the tray. In one alternative, the gas is introduced into a hollow perforated tube resting on the bottom of the tray, the tube then being covered with the silica sand.

Apart from silica sand, alternative distributing materials have included vermiculite granules, expanded clay and other refractory aggregates, mineral or ceramic wool, and slotted refractory boards.

Existing gas fires sometimes incorporate a flame failure valve responsive to a pilot light. The pilot light generally requires its own piped supply of gas, the pilot assembly being provided as a "bolt-on" accessory to the basic fire. These accessories add to the cost of the fire and are often difficult to install and adjust.

Existing fires also suffer from undesirable gas hiss. Attempts to reduce or eliminate this hiss have previously been made but have been unsuccessful and/or required more complex burner trays. For example, in UK Patent 1561099 there is disclosed a gas fire burner tray fitted with a silencer which consists of a separate chamber containing a non-combustible porous material such as mineral wool or ceramic wool. The combustion region of the tray may also be part filled with mineral or ceramic wool.

A further disadvantage of exiting gas fires is that a substantial amount of heat is lost by conduction to the metal burner tray.

SUMMARY OF INVENTION

An object of the present invention is to provide an improved burner tray which overcomes at least some of the drawbacks and disadvantages associated with existing coal and log effect gas fires.

According to the present invention, there is provided a domestic gas fire comprising a metal burner tray having a gas inlet for connection to a gas supply line, and a unitary block of flexible refractory fibrous material fitted in the tray for diffusing gas emerging from the inlet over substantially the whole area of the tray.

The tray is generally provided with upstanding front, back and opposed side walls, and the block of refractory fibrous material is preferably retained by the upstanding walls in a compressed state to ensure a seal around the edges of the block. The block preferably has a rectangular cross-section with a uniform thickness in the range of 6 mm to 100 mm, and more preferably 30 mm to 70 mm.

The block also has a preferred uniform density in the range of 20 kg/m$^3$ to 250 kg/m$^3$, and more preferably in the range of 40 kg/m$^3$ to 150 kg/m$^3$. It has been found that the use of flexible refractory fibrous material, particularly ceramic fibrous material, in the form of a compressed unitary block to diffuse the gas not only produces an exceptionally quiet fire with little or no gas hiss but also, because of its insulating properties, reduces heat loss to the tray by as much as 50% and thereby significantly increases the heat output from the fire. The increased heat output is accompanied by a brighter glow which therefore enhances the decorative effect of the fire.

The compressed block also provides improved distribution of gas over the area of the tray, and is easier to handle than sand or other loose particulate materials.

The improved gas distribution enables the use of an improved pilot light arrangement, the burner tray including a pilot hole located adjacent to an external flame sensing device, such as a thermocouple, the gas emerging from the pilot hole being automatically ignited to provide a pilot flame when the burner tray is ignited.

It is also possible to make an aerated burner using a similar fibrous block to distribute the gas/air mixture. Bearing in mind the relatively large area of the burner and the consequent low velocity of the gas/air mixture through the fibre, the resistance of the fibre in such a burner would be low enough to prevent blow backs as a result of back pressure at the gas injector.

DESCRIPTION OF THE FIGURES

In the accompanying drawings, by way of example only:

FIG. 1 is a top plan view of a burner tray embodying the present invention, and FIG. 2 is a cross-sectional view on line A—A of FIG. 1.

DESCRIPTION OF THE PREFERRED EMBODIMENT

The rearwardly tapered metal burner tray 10 is designed to fit in a fire grate positioned in a conventional domestic fire back. It has a base 11 with a gas inlet 12, two upstanding side walls 13, 14 and front and back walls 15, 16. The tray 10 could have other shapes and might, for example fit in a rectangular fire basket. It could also be free standing.

The inlet 12 is located toward the front of the tray, and immediately behind the inlet 12 is a distribution bar 17 which is welded or otherwise secured to the base 11. A unitary block 18 of a flexible ceramic fibrous material having a rectangular cross-section is fitted in the tray 10. In this particular example, the block 18 rests on the base 11 of the tray. The resulting clearance around the bar 17 provides a passage 19 for the gas emerging from inlet 12, the passage 19 extending in both directions toward the opposite side walls 13, 14. The block 18 is of uniform thickness and density. It is initially cut from a continuous roll of the ceramic fibrous material, and is further cut to ensure a precise fit in the tray. In particular, the block is cut slightly oversize to ensure a compressive fit. Accordingly, each side of the block is urged against a corresponding inside surface of the respective retaining walls 13, 14, 15 and 16 to form a seal.

When the burner is ignited, the draft from the chimney generally draws the gas backwards toward the rear wall 16 and the fibrous block 18 effectively diffuses this gas over the entire area of the tray 10 while at the same time providing insulation between the gas flames and the bottom of the tray. Imitation coal or logs (not shown) are placed on top of the fibrous block 18 to provide a coal or log effect fire.

The ceramic fibre in the fibrous block 18 may comprise, for example, a block alumino-silicate fibre made from blends of high purity alumina and silica.

The rolls of ceramic fibrous material are often known as ceramic fibre blankets and can be made solely from bulk fibre without the inclusion of binders. Such blankets are at present used primarily as a lining material for low thermal mass furnaces, including ceramics kilns and petrochemical process plan.

A small pilot hole 20 is located in the side wall 13 opposite one end of the distribution bar 17 and just below the top edge of the side wall. The tip of a thermocouple heat sensing device 21 is located outside the tray close to the hole 20, the device 21 being secured to the side wall 13. The fibre blanket 18 is such an efficient gas distributor that a proportion of the gas entering through the inlet 12 emerges from the pilot hole 20 where it automatically ignites when the gas distributed over the burner tray 10 is ignited. The presence of the pilot flame is detected by the thermocouple 21 which feeds a signal to a flame failure valve 22 in the gas supply line to maintain the valve open. Since the pilot is taken directly from the main burner, it no longer requires a separate gas supply nor does it require adjustment since it is self-adjusting with the main burner gas pressure. This has the added advantage of enabling the burner to be used on natural gas or bottled liquid propane gas without any pilot adjustment.

The use of the compressed ceramic fibre blanket 18 to diffuse the gas produces an exceptionally quite fire with little or no gas hiss, and also produces an even flame distribution. Particularly good results have been achieved when using a 128 kg/m$^3$ ceramic fibre blanket with a uniform thickness of about 50 mm, and having a thermal conductivity ranging from about 0.1 W/mk at 500° to about 0.22 W/mk at 1000° C.

I claim:

1. A domestic coal or log effect gas fire apparatus comprising:

a generally horizontal metal burner tray with a base and vertical side walls upstanding from the base, the base having a gas inlet for connection to a gas supply line, and a flat bed of insulating material covering said base of the tray, the bed of insulating material supporting imitation coal or logs in a combustion region of the fire, and comprising a unitary flexible ceramic fibrous blanket retained in a compressed state by said upstanding side walls, the blanket consisting solely of bulk ceramic fiber free of binders, and being fitted in the tray above the gas inlet such that gas emerging from the inlet is diffused over substantially the whole area of the tray, producing an even flame distribution and decreased gas hiss from gas exiting said gas inlet, and said blanket insulating said metal frame from heat produced from said combustion region.

2. A gas fire apparatus according to claim 1 in which the ceramic fiber is an alumina-silicate fiber.

3. A gas fire apparatus according to claim 1 in which the blanket of ceramic fibrous material is of rectangular cross-section with a predetermined uniform thickness in the range of 6 mm to 100 mm.

4. A gas fire apparatus according to claim 3 in which the predetermined thickness is in the range of 30 mm to 70 mm.

5. A gas fire apparatus according to claim 1 in which said blanket of ceramic fibrous material has a predetermined uniform density in the range of 20 kg/m$^3$ to 250 mg/m$^3$.

6. A gas fire apparatus according to claim 5 in which the predetermined density is in the range of 40 kg/m$^3$ to 150 kg/m$^3$.

7. A gas fire apparatus according to claim 1 further comprising elongate barrier means disposed behind the gas inlet for initially directing gas outwardly toward an opposed pair of side walls, the barrier means locally supporting the ceramic fibrous blanket clear of the flat base of the tray to provide a passageway for the unimpeded flow of gas.

8. A gas fire apparatus according to claim 7 in which the barrier means comprises an elongate bar secured to the bottom of the tray.

9. A gas fire apparatus according to claim 8 in which one of the upstanding side walls includes a pilot hole disposed substantially opposite one end of the bar, the pilot hole providing a pilot flame when the burner is ignited, and in which a heat sensing device is arranged to sense the pilot flame to control a flame failure valve in the gas supply.

* * * * *